US006349677B1

(12) United States Patent
Gifford

(10) Patent No.: US 6,349,677 B1
(45) Date of Patent: Feb. 26, 2002

(54) STEAM BOILER PIPING

(76) Inventor: Henry Gifford, 230 Riverside Dr. #11C, New York, NY (US) 10025

( * ) Notice: Subject to any disclaimer, the term of this patent is extended or adjusted under 35 U.S.C. 154(b) by 0 days.

(21) Appl. No.: 09/292,418

(22) Filed: Apr. 15, 1999

(51) Int. Cl.[7] ..... F22B 37/26
(52) U.S. Cl. ..... 122/489; 122/488; 122/4 R
(58) Field of Search ..... 122/466, 486, 122/487, 488, 489, 492, 508, 34, 4 R

(56) References Cited

U.S. PATENT DOCUMENTS 2,592,530 A * 4/1952 Artsay ..... 122/488

OTHER PUBLICATIONS

Current, Weil–McLain Instructions, No. 94, Back Page, Steam Boilers Piping Diagrams.

Current, H B Smith #19 Instructions Page #5 "Typical Steam Boiler Piping Diagram".

* cited by examiner

*Primary Examiner*—Jiping Lu

(57) ABSTRACT

A steam boiler's condensate return piping is connected to the piping that directly connects the boiler outlet pipe to the boiler's water return connection above the boiler's water level to reduce water level fluctuations in the boiler.

1 Claim, 2 Drawing Sheets

STEAM BOILER PIPING

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

This invention relates to piping that connects a steam boiler to piping that carries water from condensed steam back to the boiler.

2. Description of Related Art

Steam boilers used to be connected a steam outlet pipe from the upper part of the boiler and a separate condensate return pipe at the lower part of the boiler as shown in FIG. 1. Steam left the boiler through steam outlet piping and returned through the condensate pipe. While this system worked it had two major disadvantages.

The first disadvantage is that if a condensate return pipe leaked the loss of water could lower the boiler's water level enough to damage the boiler from overheating as a result of firing without enough water in it. Second, there was no way to prevent water from sloshing back and forth between the boiler and the condensate return piping in response to small and constant pressure fluctuations resulting from the bubbling of water boiling, unsteady flow of air, water, and steam in the system piping, and opening and closing of any valves that might be in the system. This sloshing around makes control of the boiler water level by [an] automatic device difficult because the water level control apparatus is confused by the fluctuating water level.

One solution used was to install a check valve in the return pipe. A check valve is a device that has a moving doorlike flapper that is intended to be opened by flow in one direction and closed by flow in the other direction. The check valve protected the boiler from a sudden loss of water out a leaking condensate return pipe, and prevented the sloshing back and forth by permitting water to flow only one way in the condensate return pipe: toward the boiler. Unfortunately, check valves are unreliable. They can clog with dirt, sticking open or closed. This makes their use impractical.

The next system that became common is the Hartford Loop as shown in FIG. 2. The Hartford Loop is said to be named after one or more of the insurance companies in Hartford, Conn. that refused to insure a steam boiler installed without a Hartford Loop. It is installed by piping the condensate return pipe into the equalizer pipe about 2 to 4 inches below the boiler's water level as shown in FIG. 2.

The Hartford loop has the advantage of preventing sudden loss of large amounts of water caused by a pipe leak because gravity can't drain water uphill out the condensate return pipe. The water loss is limited to 2 to 4 inches below the boiler's water level because that is where the condensate return pipe connects to the equalizer pipe. A loss of 2 to 4 inches is generally allowable and won't damage a typical steam boiler. Steam pressure inside the boiler is prevented from forcing the water up and out the return pipe by the equalizer pipe which exerts equal pressure on the top of the condensate return piping. This is all accomplished without any moving parts or restricted areas in the piping that would be prone to clogging, thus it is very reliable. Unfortunately, the Hartford Loop has the disadvantage of not solving the problem of water sloshing around between the steam boiler and the condensate return piping. Despite this drawback the safety and reliability of the Hartford Loop has caused it to come into widespread use. The sloshing around problem has become accepted as normal despite the difficulty associated with use of automatic water level control apparatus on a boiler where the water sloshes around.

BRIEF SUMMARY OF THE INVENTION

The present invention comprises a condensate return pipe connected to the equalizer pipe above the boiler's water level.

DETAILED DESCRIPTION OF THE INVENTION

Figure 1:
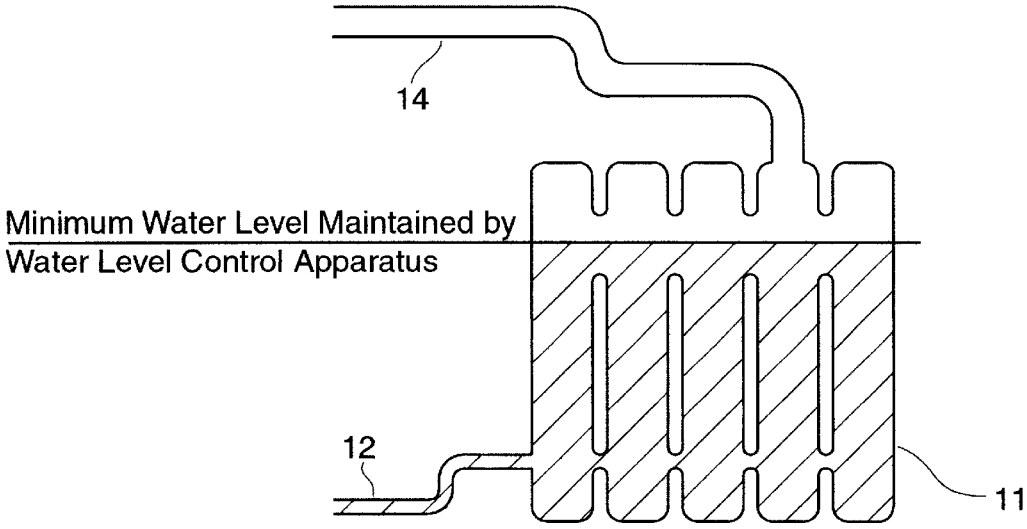
Fig. 1 Prior Art
FIGS. 1 and 2 are drawings of prior art.
Figure 2:
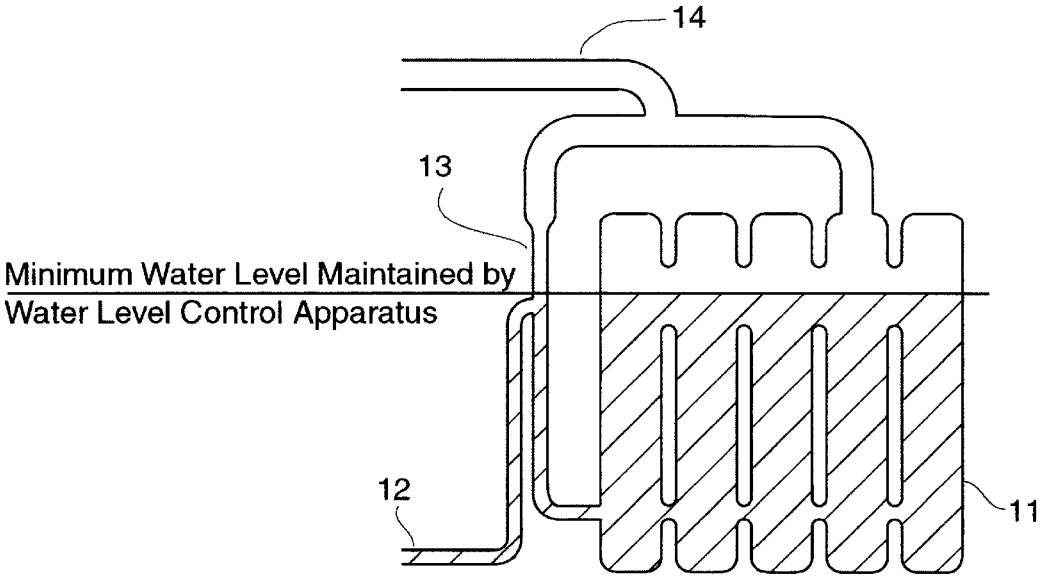
Fig. 2 Prior Art
Figure 3:
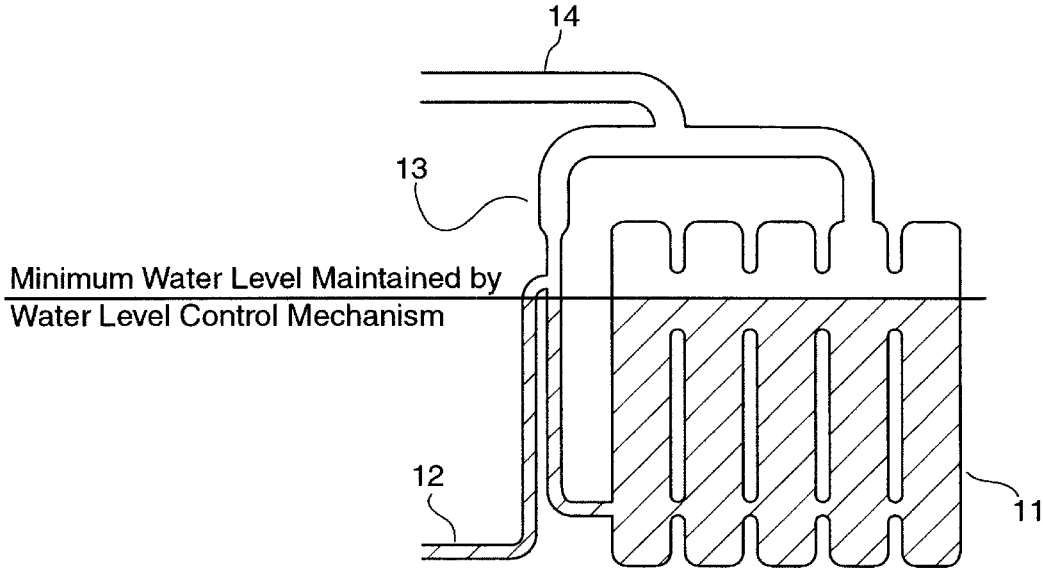
FIG. 3 is a drawing of the present invention.
Figure 4:
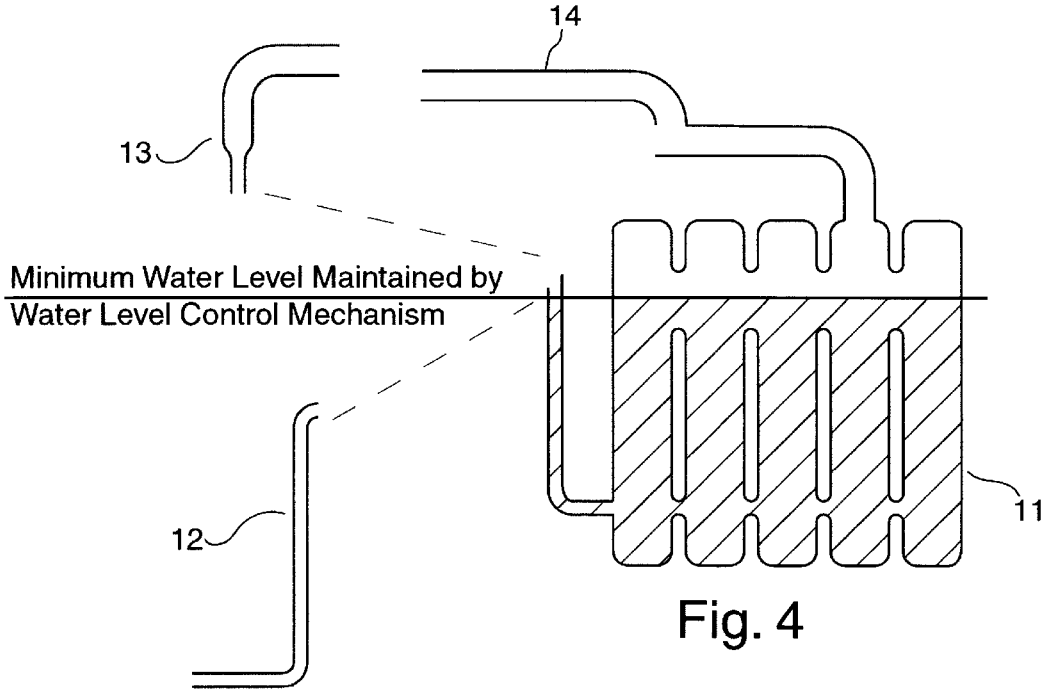
FIG. 4 is an exploded view of the present invention.

The condensate return pipe 12 connects to the equalizer pipe 13 above the boiler's water level. In the preferred embodiment the condensate return pipe 12 connection to the equalizer pipe 13 is located where the bottom of the inside of the condensate return pipe 12 is located 1 inch above the boiler's water level as shown in FIG. 3. Neither leaks in the condensate return pipe 12 nor steam pressure inside the boiler 11 can lower the water lower than the bottom of the inside of the condensate return pipe 12 where it connects to the equalizer pipe 13. Fluctuations in the pressure difference between the condensate return piping 12 and the steam system piping 14 can push water into the boiler 11 but not out of the boiler 11. This piping arrangement performs the function of a check valve but suffers from none of the reliability issues associated with check valves. This has the advantage of making the boiler's water level steady and easy to control by use of automatic water level control apparatus.

Other embodiments comprise connecting the condensate return pipe 12 to the equalizer pipe 13 at different levels above the water level.

Other embodiments comprise connecting the condensate return pipe 12 directly to the boiler 11 above the boiler's water level.

The above description and figure illustrates some of the preferred embodiments of the invention. There are many alternatives in addition to the ones disclosed above that fall within the scope of the disclosed concepts. The disclosed embodiments represent what is regarded as the best modes for practicing this invention, they are not intended as limiting the scope of the invention.

What is claimed is:

1. A method for controlling water level in a steam boiler 11, the steam boiler 11 comprising a steam system piping 14 connected to a top portion of the steam boiler 11 and a condensate return pipe 12 connected to an equalizer pipe 13, one end of the equalizer pipe 13 connected to said steam system piping 14, and other end of the equalizer pipe 13 connected to said steam boiler 11 adjacent its bottom portion, a predetermined water line is located at an upper portion of the steam boiler, the method comprising the steps of:

Connecting the condensate return pipe 12 to said equalizer pipe 13 at a location above said predetermined water line;

conveying return condensate through the condensate return pipe 12 to the equalizer pipe 13;

maintaining a constant water level at the water line below a connecting junction between said condensate return pipe 12 and said equalizer pipe 13;

maintaining a substantial pressure within the equalizer pipe 13 for controlling the constant water level at the water line below the junction;

conveying steam out of the steam system pipes, whereby the constant water level is maintained and controlled at the water line below the connection junction.

* * * * *